US005323497A

United States Patent [19]

Lih et al.

[11] Patent Number: 5,323,497

[45] Date of Patent: Jun. 28, 1994

[54] TOILET SEAT LIFTING DEVICE

[76] Inventors: Yin-Peng Lih, No. 149 Charng Show Street; Miin-Tsang Sheu, No. 156 Cheng Kung Road, both of Chang Hua City, Taiwan

[21] Appl. No.: 121,434

[22] Filed: Sep. 16, 1993

[51] Int. Cl.[5] ..... A47K 13/10

[52] U.S. Cl. ..... 4/667; 4/564.1; 297/DIG. 10

[58] Field of Search ..... 4/246.1, 667, 560.1, 4/561.1, 564.1; 297/DIG. 10

[56] References Cited

U.S. PATENT DOCUMENTS

| | | | |
|---|---|---|---|
| 1,288,216 | 12/1918 | Sayles | 297/DIG. 10 |
| 3,479,087 | 11/1969 | Burke | 297/DIG. 10 |
| 3,914,806 | 10/1974 | Pearce | 4/564.1 |
| 4,133,062 | 1/1979 | Fulbright, Jr. | 2/246.1 |
| 4,168,552 | 9/1979 | Austin | 4/667 |
| 5,063,617 | 11/1991 | Ward et al. | 297/DIG. 10 |
| 5,147,104 | 9/1992 | Zalewski | 297/DIG. 10 |

FOREIGN PATENT DOCUMENTS

| | | | |
|---|---|---|---|
| 9306766 | 4/1993 | PCT Int'l Appl. | 4/667 |
| 2183150 | 6/1987 | United Kingdom | 297/DIG. 10 |

*Primary Examiner*—Henry J. Recla
*Assistant Examiner*—Gregory W. Vidovich
*Attorney, Agent, or Firm*—Bacon & Thomas

[57] ABSTRACT

A toilet seat lifting device comprised of a box fastened to the toilet bowl of a toilet at the top near the back, two sliding racks made to slide in two bevel guide channels on the bottom of the box at two opposite sides, a transmission assembly driven by a slow speed motor to move the sliding racks up and down along the guide channels, and a toilet seat covered on a toilet bowl and having a rear end pivotably connected between the sliding racks, whereby the toilet seat is lifted and lowered between a horizontal position and a bevel position to help the user sit on the toilet seat or stand up from the toilet seat as the slow speed motor is controlled to move the sliding racks forward and backward alternatively.

2 Claims, 5 Drawing Sheets

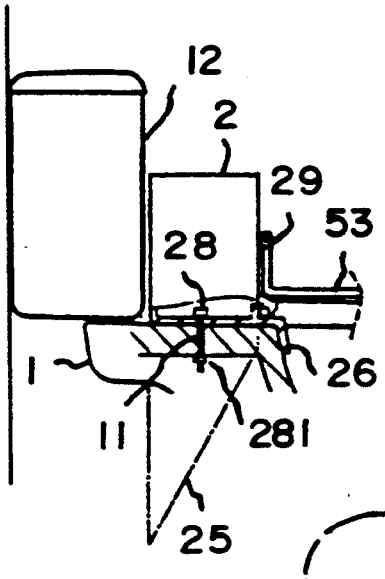
FIG. 3
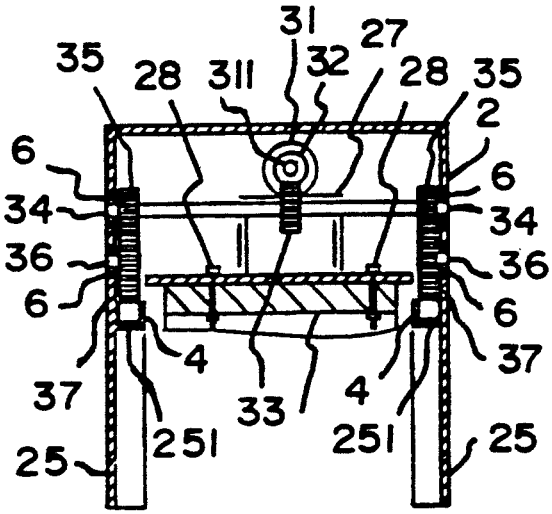
FIG. 4
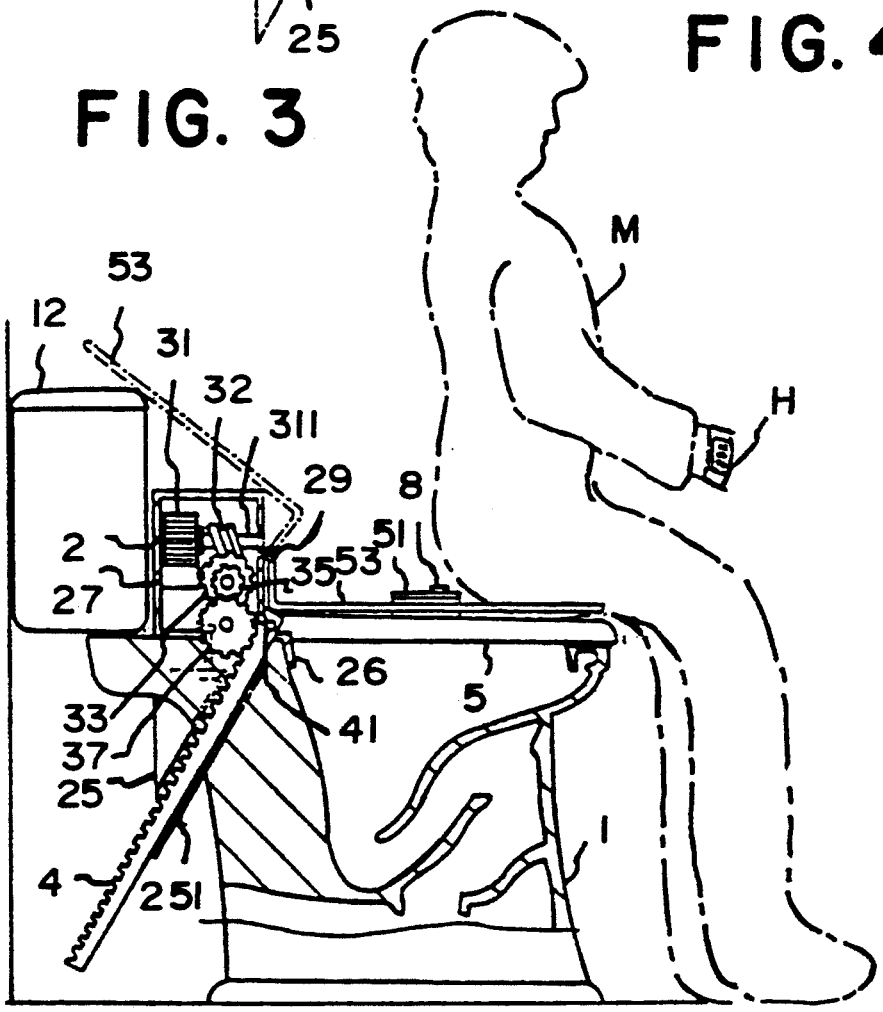
FIG. 5-A

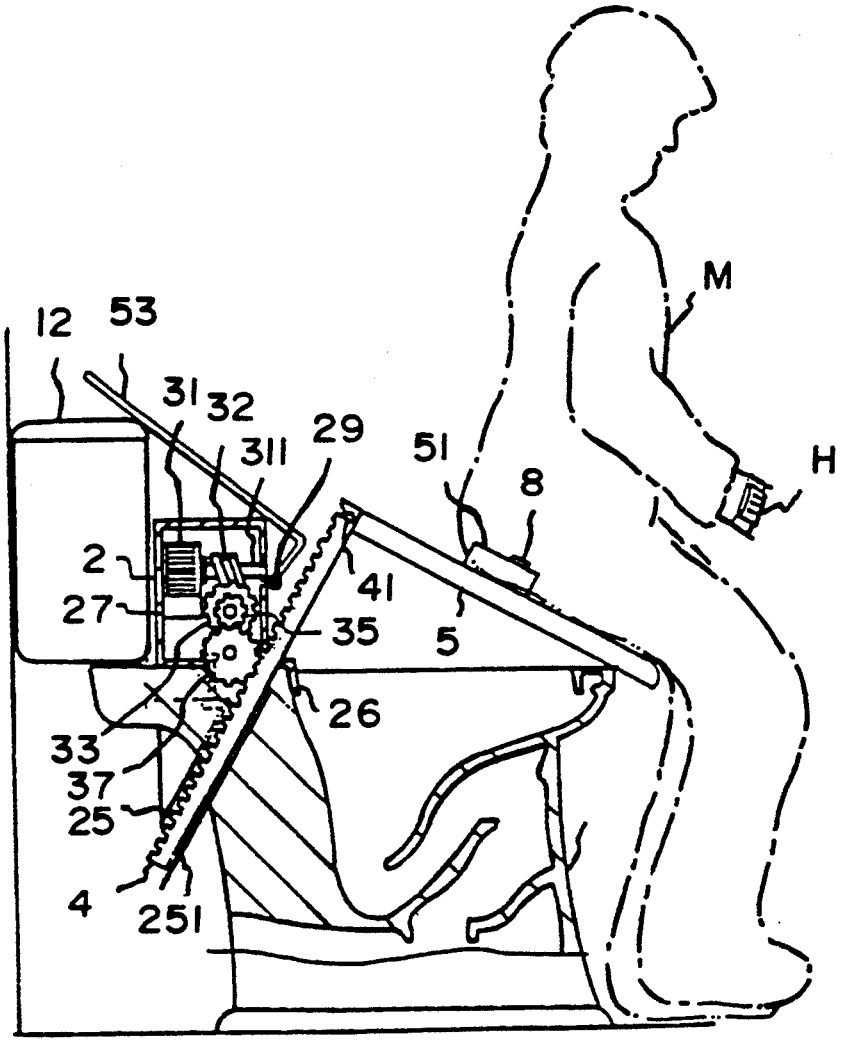
FIG. 5-B

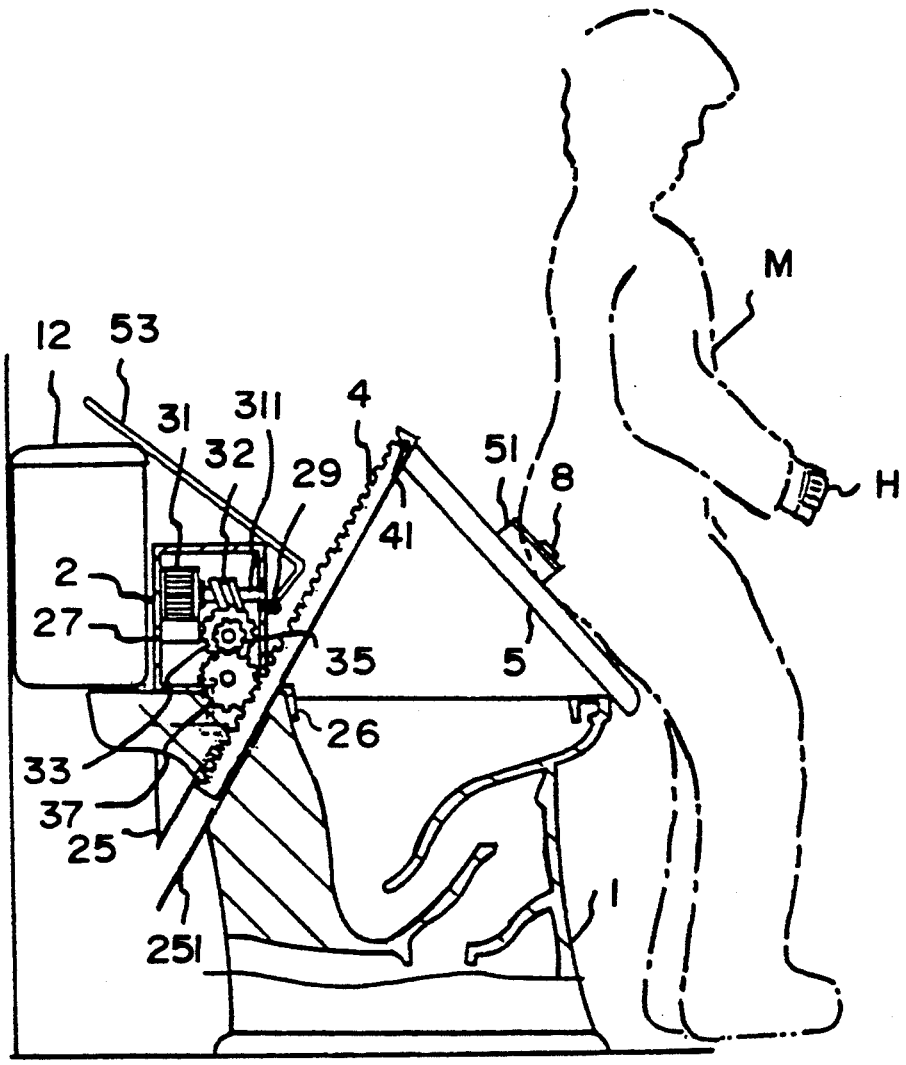
FIG. 5-C

TOILET SEAT LIFTING DEVICE

BACKGROUND OF THE INVENTION

The present invention relates to a toilet seat lifting device controlled to lift the toilet seat for helping a patient sit on the toilet seat and stand up from the toilet seat. The lifting device uses a slow speed motor controlled by a switch to alternatively move two sliding racks forward and backward along two obliquely disposed guide channels, and therefore the toilet seat which is pivotably connected between the sliding racks is alternatively lifted and lowered between a horizontal position and a bevel position to help the user sit on the toilet bowl or stand up from it.

Going to the toilet is a pain to an old, apoplectic man, because an old, apoplectic man can not sit on the toilet seat and stand up from it without the assistance of other people or the use of supporting devices. It is also dangerous to an old or apoplectic man to use the toilet without the assistance of others. However, it is not difficult to take care of an old, apoplectic man 24 hours a day on every detail.

SUMMARY OF THE INVENTION

The present invention has been accomplished under the aforesaid circumstances. It is therefore the principal object of the present invention to provide a toilet seat lifting device which helps old, disabled persons use the toilet without effort. It is another object of the present invention to provide a toilet seat lifting device which can be conveniently controlled by the user himself (herself). It is still another object of the present invention to provide a toilet seat lifting device which can be installed in any of a variety of existing toilets.

According to one aspect of the present invention, the toilet seat lifting device is comprised of a box fastened to the toilet bowl of a toilet at the top near the back, two sliding racks made to slide in two bevel guide channels on the bottom of the box at two opposite sides, a transmission assembly driven by a slow speed motor to move the sliding racks up and down along the guide channels, and a toilet seat covered on a toilet bowl and having a rear end pivotably connected between the sliding racks. By turning on the slow speed motor in one direction, the toilet seat is lifted from a horizontal position covered on the toilet bowl to a bevel position for supporting the hip of the user before the user sits down. By turning on the slow speed motor in the reversed direction, the toilet seat is then lowered from the bevel position to the horizontal position to help the user sit down on the toilet bowl without effort.

According to another aspect of the present invention, a control switch is installed on the handrail on either side of the toilet seat so that the user can operate the device conveniently.

BRIEF DESCRIPTION OF THE DRAWINGS

FIG. 3 is a schematic drawing showing the position of the box of the toilet seat lifting device on the toilet bowl;

FIG. 4 is a back view in plan of the transmission assembly of the toilet seat lifting device;

FIG. 5A shows the toilet seat disposed in the horizontal position as the sliding racks moved to the lower limit;

FIG. 5B shows the sliding racks moved upward to lift the toilet seat; and

FIG. 5C shows the toilet seat moved to the bevel position by the sliding racks moved.

DETAILED DESCRIPTION OF THE PREFERRED EMBODIMENT

Figure 1:
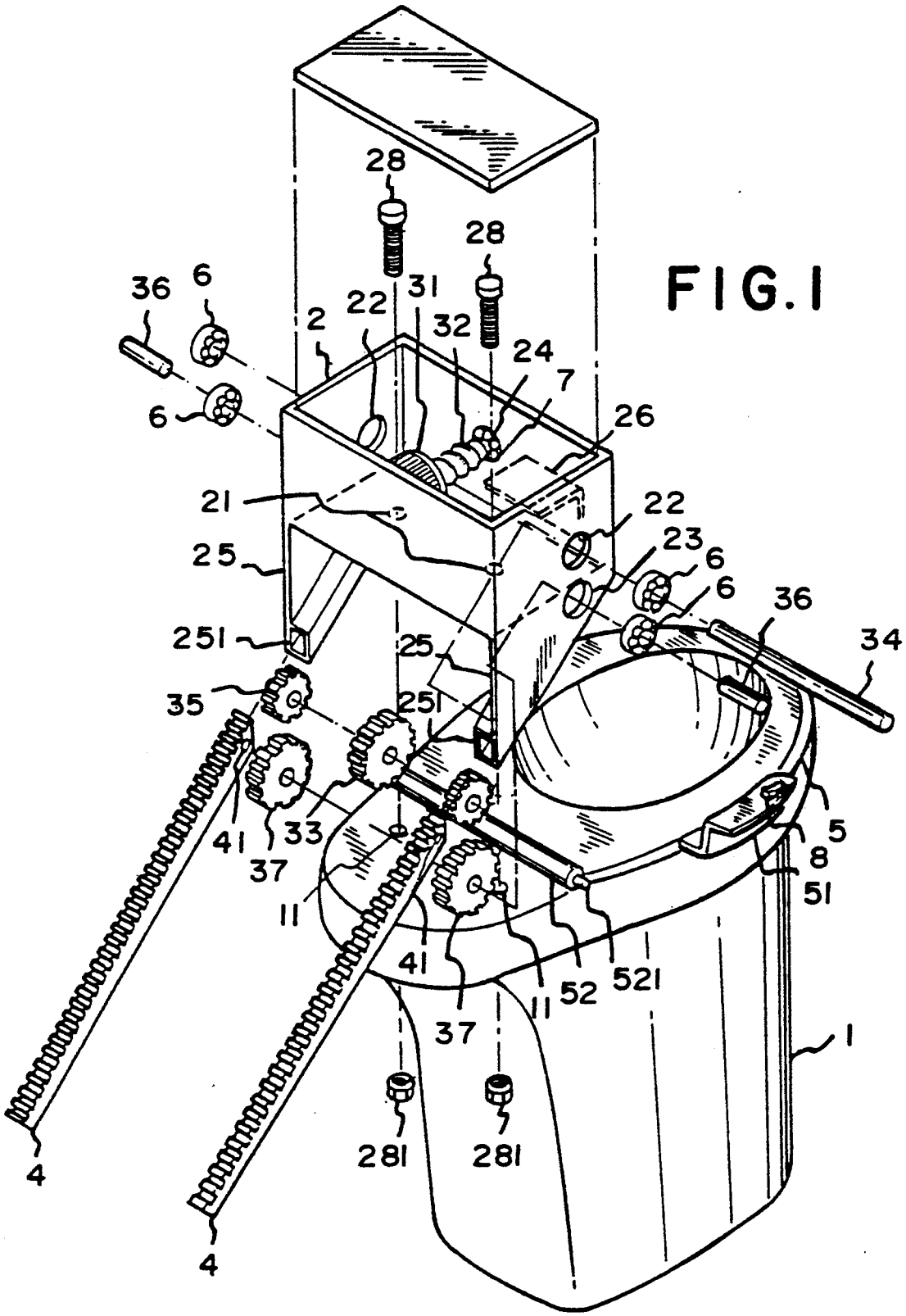
FIG. 1 is a perspective exploded view of a toilet seat lifting device according to the preferred embodiment of the present invention.
Figure 2:
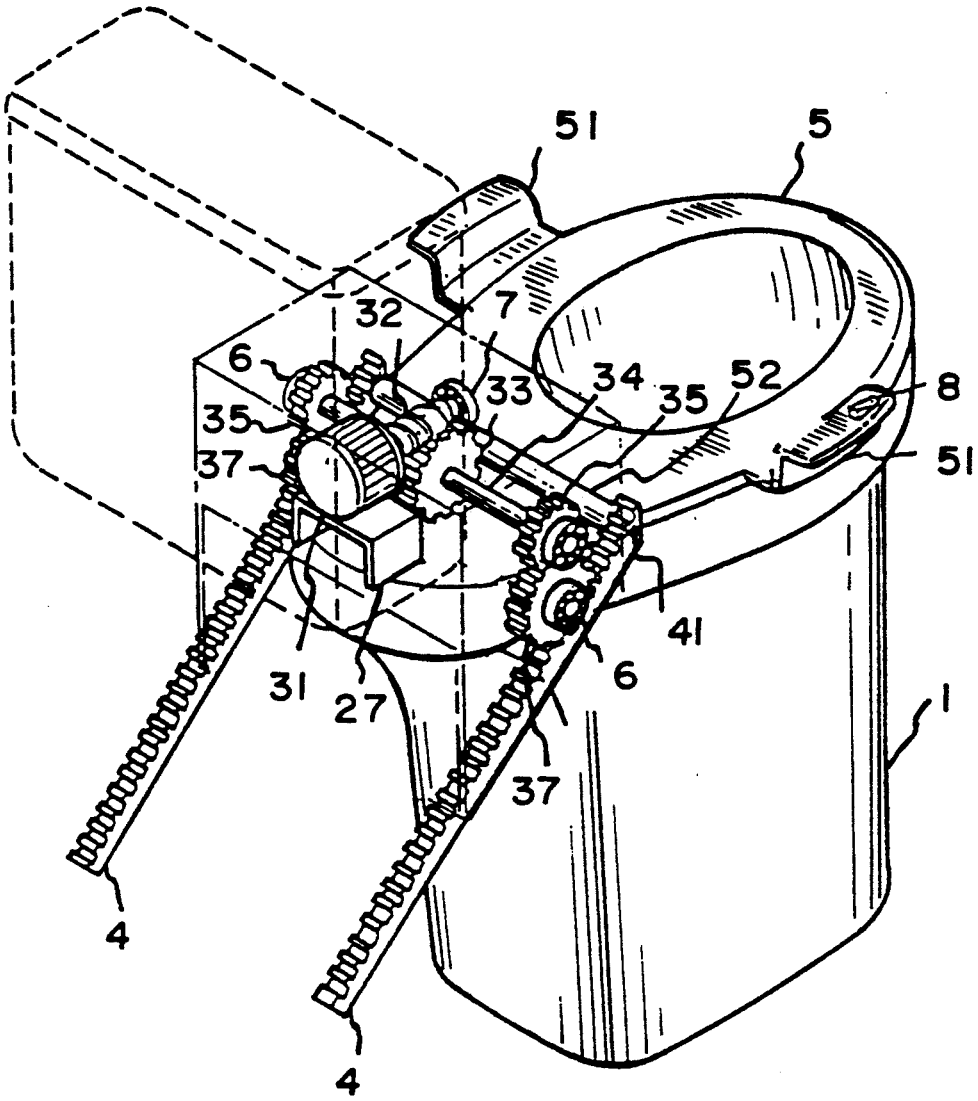
FIG. 2 is a perspective assembly view of the toilet seat lifting device of FIG. 1.

Referring to FIGS. 1, 2, 3, and 4, a toilet seat lifting device in accordance with the present invention is generally comprised of a box 2, a transmission assembly, a toilet seat 5, and a pair of sliding racks 4.

The box 2 is made in a substantially rectangular configuration, and installed on the toilet bowl 1 of a toilet at the top near the back. A plurality of bolt holes 21 are made on the bottom wall of the box 2. By inserting screw bolts 28 into the bolt holes 21 on the bottom wall of the box 2 and respective holes 11 on the toilet bowl 1 and then fastening the screw bolts 28 with respective nuts 281, the box 2 is fixed to the toilet bowl 1. Two pairs of axle holes, namely, the pair of first axle holes 22 and the pair of second axle holes 23 are made through two opposite trapezoidal side walls 25 of the box 2 and fastened with a respective axle bearing 6. Two guide channels 251 are respectively and obliquely made on the trapezoidal side walls 25 at the bottom for sliding the sliding racks 4. A front axle hole 24 is made on the front wall of the box 2 at a higher elevation than the first pair of axle holes 22, and fastened with an axle bearing 7. A motor mount 27 is fastened to the back wall of the box 2 on the inside. A hook-like locating plate 26 projects from the front wall of the box 2 at the bottom. As the box 2 is fixed to the toilet bowl 1, the hook-like locating plate 26 hooks in the cavity of the toilet bowl 1 (see FIGS. 3 and 4), and therefore the box 2 is firmly retained in place and will not be vibrated during the operation of the transmission assembly.

The transmission assembly is comprised of a slow speed motor 31, a worm 32, a worm gear 33, a transmission shaft 34, two driven gears 35, two driven shafts 36, and two reducing gears 37. The slow speed motor 31 is fastened to the motor mount 27. The output shaft 311 of the slow speed motor 32 is inserted into the axle bearing 7 on the front axle hole 24. The worm 32 is mounted around the output shaft 311 of the slow speed motor 31. The transmission shaft 34 is inserted through the axle bearings 6 on the pair of first axle holes 22. The worm gear 33 is mounted around the transmission shaft 34 in the middle and meshed with the worm 32. The driven gears 35 are mounted around the transmission shaft 34 on two opposite sides by the worm gear 33. The driven shafts 36 are respectively fastened to the axle bearings 6 in the pair of second axle holes 23. The reducing gears 37 are respectively mounted on the driven shafts 36 and meshed between the driven gears 35 and the racks 4. As the slow speed motor 31 is started to turn on the output shaft 311, the worm 32 is driven to turn the transmission shaft 34 via the worm gear 33, causing the driven gears 35 to turn the reducing gears 37, and therefore the racks 4 are synchronously moved forward or backward. Because the device is designed to help old, and apoplectic persons, the moving speed of the toilet seat must be properly controlled. Therefore, reducing gears 37 are used to match with the slow speed motor 31, so as to increase the torque and reduce the speed. The operation of the slow speed motor 31 is controlled by a control switch 8. The control switch 8 controls the slow speed motor 31 to alternatively be turned in either direction. The control switch 8 must be installed at a suitable location where the user M can touch with the hand. As illustrated in FIG. 1, the control switch 8 may be mounted on the handrail 51 on either side of the toilet seat 5.

The toilet seat 5 is mounted on the toilet bowl 1 at the top and bridged over the locating plate 26 of the box 2. Two handrails 51 are bilaterally disposed on the toilet seat 5 for supporting the user M as the user M sits on the toilet seat 5 or stands up. The toilet seat 5 comprises an axle 52 transversely disposed at the rear end thereof The axle 52 comprises two pins 521 aligned on two opposite ends thereof respectively inserted in a pin hole 41 on the top end of either sliding rack 4. Therefore, the toilet seat 5 is pivotably connected to the sliding racks 4. When not in use, the toilet seat 5 can be turned on the axis through the axle 52 and lifted from the toilet bowl 1. As the sliding racks 4 are moved to the lower limit, the toilet seat 5 becomes horizontally supported on the toilet bowl 1 (see FIG. 5A).

The sliding racks 4 are respectively inserted in the guide channels 251 and meshed with the reducing gears 37. As the reducing gears 37 are turned in either direction, the sliding racks 4 are moved upward or downward along the guide channels 251.

Referring to FIGS. 5A, 5B, 5C, as the control switch 8 is controlled by the user M to turn the slow speed motor 31 clockwise, the reducing gears 37 are turned to move the sliding racks 4 upwards. As the sliding racks 4 are moved upward, the axle 52 of the toilet seat 5 is gradually lifted from the toilet bowl 1 while the front end of the toilet seat 5 is slidingly supported on the front top edge of the toilet bowl 1. After the toilet seat 5 has been lifted from the horizontal position to the bevel position (from the position shown in FIG. 5A to the position shown in FIG. 5B and then to the position shown in FIG. 5C), the user can then position their body, primarily their hips, to be supported on the toilet seat 5, and then control the control switch 8 to turn the slow speed motor 31 in the reversed direction (counterclockwise) so as to gradually lower the toilet seat 5 from the position shown in FIG. 5C to the position shown in FIG. 5B and then to the position shown in FIG. 5A. The user M will now be in a sitting position, as shown in FIG. 5A, on the toilet seat 5. After each use, the slow speed motor 31 is controlled in the reversed procedure to help the user stand up from the toilet seat 5.

Referring to FIGS. 5A, 5B, and 5C again, a toilet seat lid 53 is provided for covering the toilet seat 5, having a L-shaped rear end hinged to the box 2 above the locating plate 26 by a hinge 29. When in use, the toilet seat lid 53 is lifted from the toilet seat 5 and supported on the box 2 and the water tank 12 of the toilet without hindering the sliding of the sliding tracks 4.

While only one embodiment of the present invention is shown and described, it will be understood that various modifications and changes could be made without departing from the spirit and scope of the invention. For example: a short-distance remote control device H may be used to replace the control switch 8, and fastened to the wrist of the user for controlling the operation of the slow speed motor 31.

What is claimed is:

1. A toilet seat lifting device comprising:

a box adapted to be on a top surface of a installed toilet bowl of a toilet, said box comprising a front wall, a rear wall, two trapezoidal side walls bilaterally connected between said front and rear walls, a bottom wall adapted to be fastened to the top surface of the toilet bowl, a front locating plate connected to the front wall and adapted to be hooked to the toilet bowl for securing said box to the toilet, two guide channels respectively formed on each of said trapezoidal side walls and disposed on opposite sides of the toilet bowl;

a transmission assembly fastened inside said box, said transmission assembly comprised of a slow speed motor having an output shaft, a worm mounted around the output shaft of said slow speed motor, a transmission shaft having opposite ends rotatably mounted within said box, a worm gear mounted around said transmission shaft and meshed with said worm, a driven gear mounted on each of said opposite ends of said transmission shaft, two driven shafts each fastened respectively to a respective axle bearing on each of said side walls of said box, two reducing gears each mounted respectively said driven shafts and meshed with each of said driven gears on each of respectively;

two sliding racks having first and second ends wherein said second end is proximate the top surface of the toilet and made to slide in said guide channels, respectively, said sliding racks being respectively meshed with said reducing gears, each sliding rack having a pin hole near said second end;

a toilet seat having rear and front ends adapted to be mounted on the top surface of the toilet bowl, said toilet seat comprising an axle transversely disposed at a rear end thereof, said axle having pins aligned on opposite ends thereof and inserted in said pin hole on each of said sliding racks, respectively; and a control switch connected to said slow speed motor controlled by the user to turn on said slow speed motor and control its revolving direction;

whereby turning on said slow speed motor in one direction causes said sliding racks to be obliquely moved upward along said guide channels in lifting said toilet seat from a horizontal position in which said rear and front ends are adapted to be supported on the top surface of the toilet bowl to a bevel position wherein said front end is adapted to be slidingly supported on the top surface of the toilet bowl for supporting a user's hip; turning on said slow speed motor in the reversed direction causes said sliding racks to be obliquely moved downward along said guide channels in lowering said toilet seat from said bevel position to said horizontal position so as to help a user sit on the toilet bowl.

2. The toilet seat lifting device of claim 1 wherein said toilet seat is covered with a toilet seat lid, said toilet seat lid having a L-shaped rear end hinged to said box above said locating plate.

* * * * *